US005986201A

United States Patent [19]

Starr et al.

[11] Patent Number: 5,986,201

[45] Date of Patent: Nov. 16, 1999

[54] MIDI MONITORING

[75] Inventors: Troy Starr, Middleton, Wis.; Mark Hunt, Derby, Del.

[73] Assignee: Light and Sound Design, Ltd., Birmingham, United Kingdom

[21] Appl. No.: 08/741,266

[22] Filed: Oct. 30, 1996

[51] Int. Cl.[6] ..... G10H 7/00

[52] U.S. Cl. ..... 84/645; 84/464 A

[58] Field of Search ..... 84/600, 645, 464 R, 84/464 A

[56] References Cited

U.S. PATENT DOCUMENTS 5,270,480 12/1993 Hikawa ..... 84/645
5,275,082 1/1994 Kestner-Clifton et al. ..... 84/464 R X
5,329,431 7/1994 Taylor et al. .
5,406,176 4/1995 Sugden .
5,461,188 10/1995 Drago et al. ..... 84/600
5,484,291 1/1996 Nakai et al. .
5,495,072 2/1996 Kumagi ..... 84/609 X

*Primary Examiner*—Jeffrey Donels
*Attorney, Agent, or Firm*—Fish & Richardson P.C.

[57] ABSTRACT

MIDI settings indicating a musical part of a show are used to control a lighting effect associated with the show. Events within the music, such as a specified chord, can be used to trigger a certain MIDI effect. The collection of MIDI settings can also be used to determine the current song being played.

25 Claims, 5 Drawing Sheets

MIDI MONITORING

FIELD OF THE INVENTION

The present invention relates to a system which monitors messages used for production and/or monitoring of music in a musically-based stage show, and uses information from these messages to carry out another function unrelated to the production of music.

BACKGROUND AND SUMMARY

Many modern musical instruments include the facility to communicate using music production messages. MIDI is a commonly used music production message. However, other protocols including serial format, Firewire (™) and others may be used for transmission of such messages.

Many musical instruments produce MIDI messages which are communicated on a MIDI cable. These MIDI messages include information indicative of the musical production: including, but not limited to, pitch, length of time of the note, fermata, tone, and the like.

This MIDI information has been produced by the devices producing the music. MIDI has been used as a control for synthesizers and other electronically-controllable musical instruments. One common use of MIDI signals is to control a synthesizer based on musical information output by a musical instrument, e.g. guitar, for example. MIDI has also been used to produce music, e.g computer-generated music where the musical instrument is a computer.

The lighting effect in a musical performance is often an important part of the effect of the performance. The performer choreographs and presents the performance. However, the performer is often too busy to interact with the lighting effect during the performance. It is believed by the inventors that many performers would be interested in controlling and/or synchronizing certain aspects of the performance.

The present invention allows operations from the stage, which operations are part of the performer's usual performance sequence, to control some aspects of the non-musical part of the show, e.g., the lighting operation.

The non-musical production of the show has traditionally been non-MIDI based. One common controlling format is DMX-512 ("DMX"), which time division-multiplexes a number of signals on a common cable. DMX-controlled accessories, such as light shows, curtain raise and drop, and other stage accompaniments to the musical program, have often been manually controlled by an operator. The control is based on events that transpire on the stage.

The inventors of the present invention have recognized that the MIDI information that is produced by the sound part of the show can also be used to control other parts of the show. The production information from the stage can be used as a basis and synchronization cue to make complex decisions about the progression of the parts of the show that have traditionally been non-MIDI based: e.g., manual controls of the time when a lighting effect is started.

In recognition of this capability, it is an object of the present invention to use the MIDI data which has been traditionally used to control some musical aspect of the show, to control certain actions related to the non-musical progression of the show. The preferred embodiment uses instrument monitoring information, e.g., MIDI information, to control aspects of stage lighting for the show. These decisions can include, but are not limited to, synchronization of certain aspects of the lighting effect from the show with MIDI events.

In a preferred embodiment, a show is formed randomly—e.g., a number of songs form the show; but there is no predefined order to the songs. The performers on the stage decide the order of the show.

Each song has its own unique accompaniment which is carried out by the stage lighting operation. The operator controls this accompaniment with a complicated sequence of lighting effects. However, the operator has no idea in advance what song will be played. This has caused practical problems for an operator, e.g., an operator of a light show.

One aspect of this invention uses the computer to investigate MIDI settings to determine a pattern of MIDI settings which suggests which song is going to be played. Various aspects of this operation are used herein. In a particularly preferred embodiment, the group of MIDI settings are compared against a table listing all possible MIDI settings for all songs. When the lists are in agreement by a certain percentage, a decision is made that the entry in the list corresponds to the current song being played. This allows automated detection of the song being played.

The inventor also recognized that it was important to allow some leeway for discrepancies, since it is desirable to recognize the song as quickly as possible. Also, the operators may themselves make mistakes in their MIDI settings. Therefore, another aspect of this system is to allow a fuzzy logic-like determination.

Another desirable feature is to allow some aspect of the light show to be synchronized with some aspect of the musical program. This could be done by manually synchronizing light operation with the musical operation. However, manual synchronization is imprecise, and also requires that the operator very carefully pay attention to the musical program. This interferes with the operator's attention to other duties that may require the operator's attention.

In view of the above, the present invention provides an automated computer system which can carry out this automatic synchronization. According to this aspect of the present invention, a data stream that includes information indicative of the musical program is investigated to determine musical events. Those musical events are used to synchronize some aspect of the non-musical events with the musical events. In a preferred embodiment, notes produced by the instrument produce corresponding MIDI values indicative thereof. Detection of instances in the MIDI stream enables detection of an item in a sequence. In a particularly preferred embodiment, for example, a MIDI value is used to increment the operation to the next cue in a chase.

Another improvement was based on the inventor's recognition that only a part of the MIDI note stream represents the desired synchronization part. Another aspect uses a special filter to determine parts of the MIDI stream to which the operations should be synchronized. This filter looks for a predetermined pattern of MIDI information indicating a predetermined part of the show, and does not initiate an operation until that pattern is received.

DESCRIPTION OF THE PREFERRED EMBODIMENT

Figure 1:
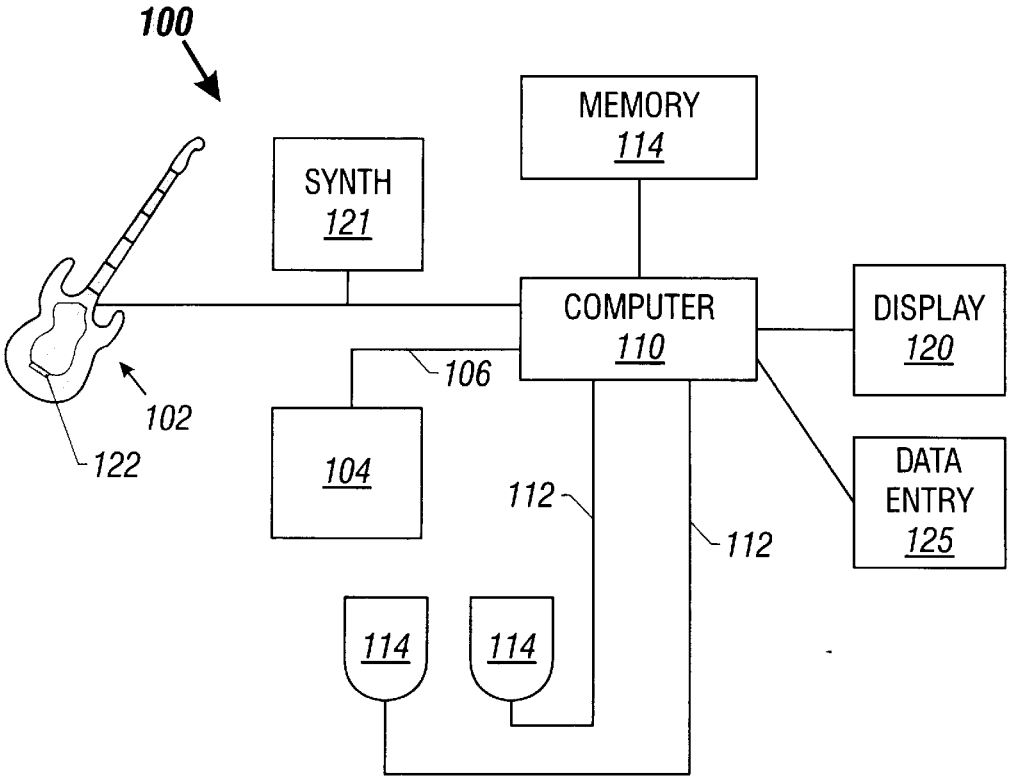
FIG. 1 shows a block diagram of a typical stage with musical instruments and controlled lamps.

The basic system of the present invention is shown in FIG. 1. The musical instruments making up the show are shown generically as guitar 102 and keyboard 104. It should be understood that any number and kind of such musical instruments could make up the show. Guitar 102 is shown connected through MIDI cable 103 to computer 110. In a similar way, keyboard 104 is connected through MIDI cable 106 to computer 110. Synthesizer 121 is also connected to MIDI cable 103. Guitar 102 also includes controls 122 which change some aspect of the music produced thereby.

The connections shown in FIG. 1 are merely illustrative, and it should be understood that these MIDI cables can be connected through other items before reaching the computer ("daisy-chained"), or alternatively through the computer 110 to the other items and that formats other than MIDI are contemplated. Also, while FIG. 1 only shows the MIDI cable 103 extending from the instruments 100 to the computer 110 ("MIDI monitoring cables"), it should be understood that MIDI controlling cables can also be provided, but are not shown herein for clarity.

Computer 110 controls a lighting effect, as known in the art. The control path is shown generically as lines 112 which extend to stage lighting lamps 114. The computer 110 can be of any desired kind. Preferably, computer is an ICON Console (™) available from Light and Sound Design, Birmingham, UK. This device produces a separate controlling line for each of the lamps being controlled. Alternative control formats, including using DMX over a single line or other such systems, are also known and contemplated.

Computer 110 includes an associated display 120 which informs the user of current operation, and includes an entry device such as keyboard 125. Computer 110 operates based on a program in its memory 130. The program controls the computer 110 which operates according to the stored programs described in the following flowcharts.

Figure 2:
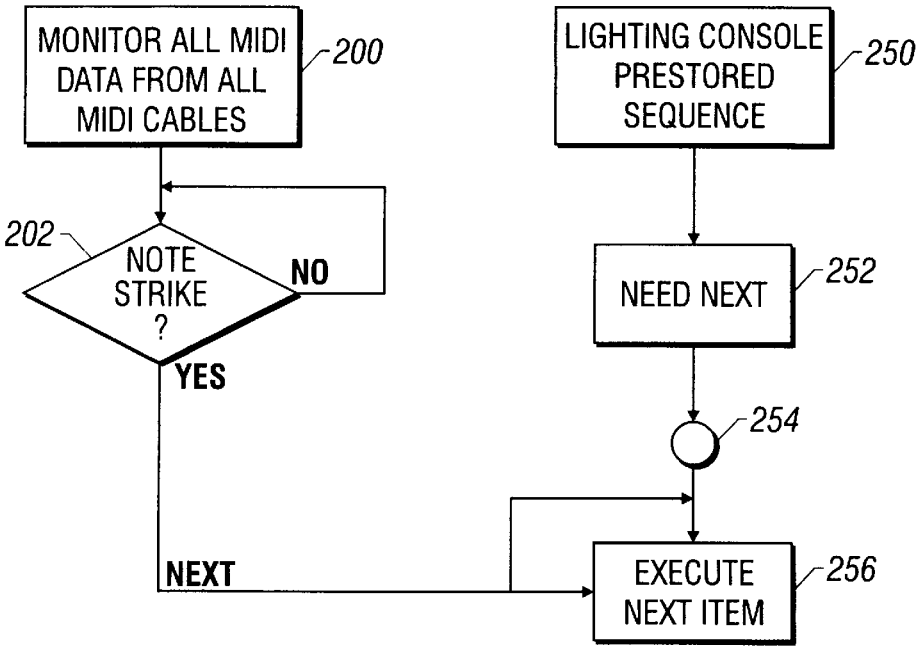
FIG. 2 shows a flowchart of operation of a first embodiment of the present invention.

The flowchart of FIG. 2 represents control of the light show, but does not show the specific details about operation of the console. Operation of this console is well known and conventional in the art. The FIG. 2 flowchart shows how the system of the first embodiment interacts with the existing console operation.

According to this invention, some aspect of the MIDI stream representing production of sound is used as a stimulus for some non-MIDI operation, here the stage lighting. This first embodiment operates based on timing of MIDI events.

Step 200 represents the console monitoring the data from all the MIDI cables. In this embodiment, the lighting console runs a pre-stored sequence 250. That pre-stored sequence includes an operation 252 shown as "need next", which requires some indication to proceed. Operation 252 represents a conditional step. The next step or instruction in the program will not be processed until receiving a specified synchronization. In prior systems, this indication might be a button-press produced by the operator to synchronize with some event during the musical show. This interaction is produced by an occurance within with the MIDI data produced by at least one of the musical instruments forming the show. Step 254 indicates that synchronization using the MIDI information.

That indication is produced by the MIDI monitoring process which monitors the MIDI stream at step 200. This process looks at MIDI events at step 202. This embodiment monitors note strikes at 202. Detection of the note strike at step 202 returns an indication 254 that the next event in the lighting process should be executed. This indication then enables the next element in the sequence to be executed at step 256 at some time that is related to the timing of the MIDI event.

The MIDI event here represents that a next note has been selected. This is used to select the next action in a sequence of actions. A chase, for example, is a stored sequence of lighting effects which are executed one after another. A chase typically includes lighting effect A followed by lighting effect B followed by lighting effect C etc. The time when the events are selected is commanded by 254.

This embodiment can operate using a specific instrument as the designated instrument. This could be, for example, the instrument of the band leader or the main tempo originator, such as the drummer. Each time a MIDI note is produced by the designated instrument, that MIDI note is detected as the event that advances the lighting to the next effect in the sequence. More generally, however, any lighting effect could be controlled in this way, using any MIDI event. Examples of these controllable lighting effects are described in further detail herein.

Another particularly preferred aspect is described with reference to FIG. 3. This embodiment uses the content of the musical program, e.g., the MIDI stream, to change the content of the lighting effect. The preferred embodiment adjusts the lighting effect based on the notes that are played by a stringed instrument, such as a guitar. The pitch of a note played by a guitar, for example, can be changed by bending the guitar string. The string bending changes the pitch content of the MIDI note. This controls the hue of the lighting effect to change correspondingly and in synchronization with the bending of the string.

Figure 3:
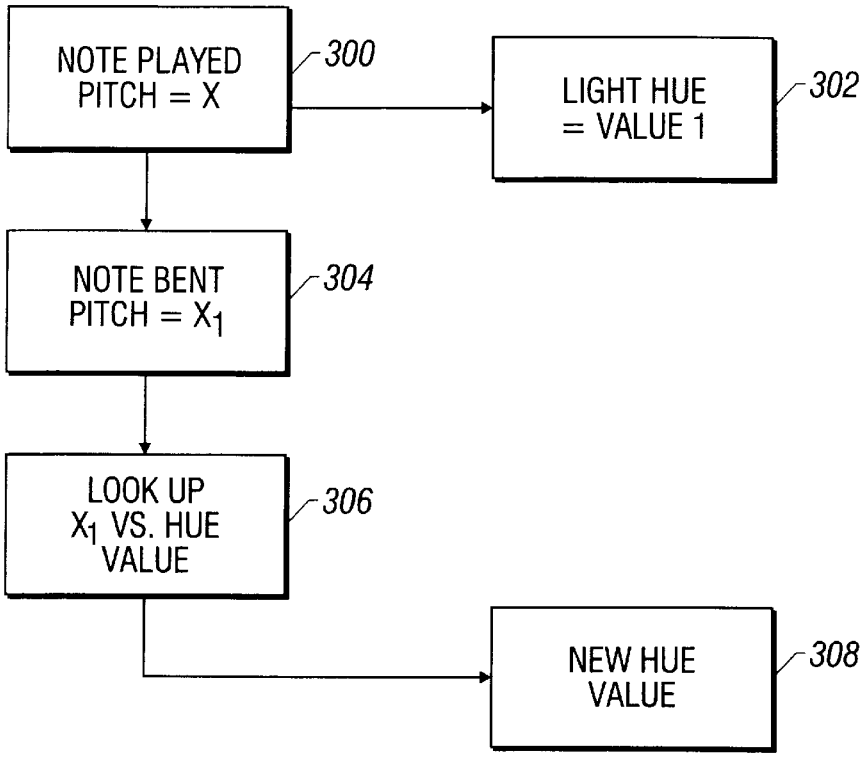
FIG. 3 shows an embodiment of the invention that correlates the content of the music being played with lighting effect.

FIG. 3 shows a note being played at step 300. This note has a pitch which we call X. The pitch could be, for example, 440 hertz representing a specific "A" note.

At the time when the pitch is the value X, the light hue is at a weighting of 1 as shown at step 302. This weighting of 1 represents a baseline, and the hue will be changed from this baseline to another value. For example, when the pitch is at the unchanged normal value, the hue value may be blue.

The note is bent at step 304, i.e., it is changed slightly from its baseline value to another pitch value $X_1$. This pitch indicates a bent note. Step 306 looks up the bent note in a look-up table which includes a table of delta values versus hue values.

$$\text{The delta percentage} = \frac{x1 - \text{baseline}}{\text{baseline}}.$$

An alternative to delta values is to use percentage change in the note being played, or absolute pitch values.

For example, if the string is bent by 10%, it changes the hue to a deeper saturation of blue, e.g., 10% more saturated. The specifics of the way the note is changed could, of course, be configured in any way. The new hue value is read out and returned to the program at step 308.

Although the above-described technique refers to bending of a note, it should be understood that changing to different notes can also obtain a similar result.

Figure 4:
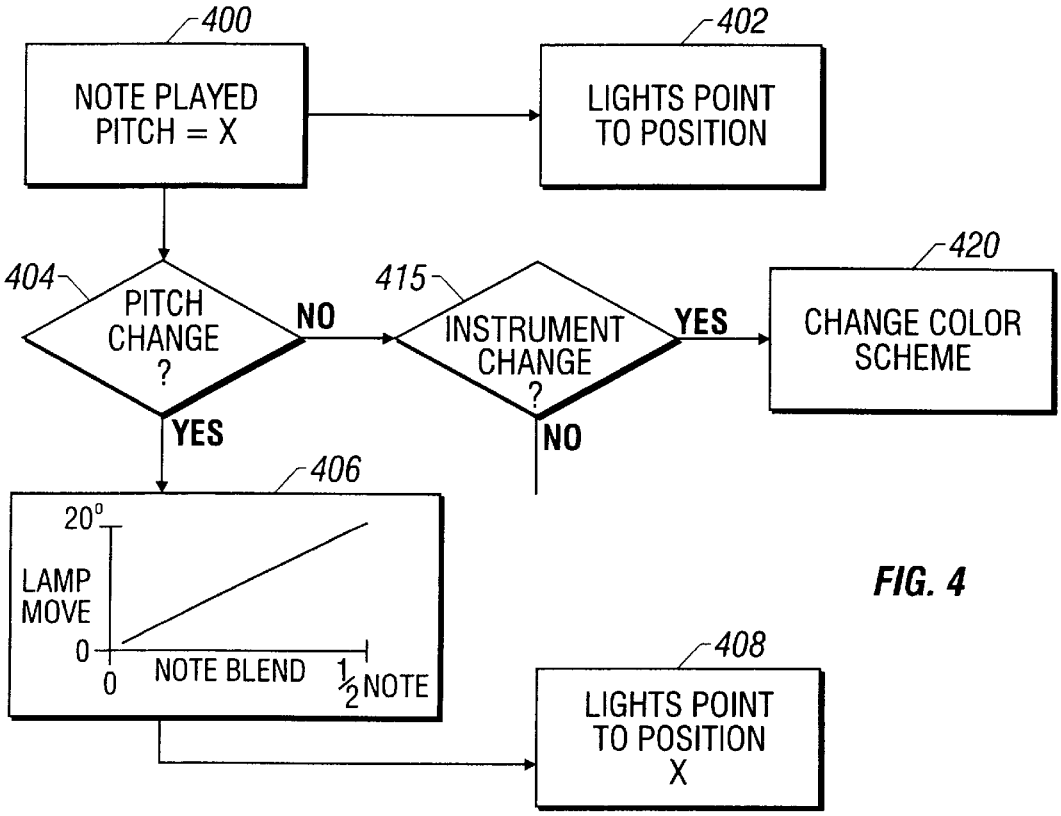
FIG. 4 is a modification of FIG. 3 that changes light position based on musical content.

Another preferred embodiment uses the content of the music, e.g., the note bending operation, to change the physical pointing of the lights. A flowchart of this physical pointing operation is shown in FIG. 4. The FIG. 4 embodiment has lights which are aimed in a particular direction which is referred to as position 0. The lighting effect control aims these lights at a desired position according to the present program.

Step 400 monitors the pitch of notes in the MIDI stream. At step 400, the note is played at the baseline pitch. The lights are commanded at step 402 to go to position 0. A note bend is detected at step 404 by detecting a pitch change to a new pitch $X_1$. Step 406 shows a map between the pitch changing due to the string bending and the lights moving in synchronism with that pitch change. A maximum light position movement amount of 20° is defined. A straight line relationship between the string bend amount and the amount of movement of the lights is preferably established as the map shown in step 406. A movement value is selected from the map and output at step 408 as a new light position.

The above describes synchronization with stringed instruments, but it should be understood that such synchronization can also be carried out using the content of other instruments. For example, cues can be advanced based on drumbeats, and cues can also be changed based on other indications including drumrolls, cymbal crashes, or any other defined sequence of musical operation(s). Any note or change from any keyboard, wind or any other kind of instrument can alternately be used. Any defined sequence or operation carried out by that wind instrument can effect any of the previously-described lighting operations. This includes pitch bends, velocity of notes, and the like. An important feature of this embodiment is that information from the stage effects lighting operation based on content. This lighting activation is hence content activated.

Another example of MIDI content controls is the change of variables described above based on loudness of the note.

Yet another exemplary operation allows a change in instrument to change the hue of the light. The detection of this parameter is shown at step 415. When the performer changes from playing guitar to playing mandolin, the detection of the new instrument's presence can entirely change the color scheme. Step 415 determines from the MIDI stream when an instrument has been changed. Step 420 shows changing from color scheme 1 to color scheme 2 when the specific instrument number 2 is detected. This allows the user to control such an operation from the stage.

This color change can use a specific color translation map, or alternatively can command translation of the color to its complement. As described above, any desired MIDI data can run a cue, change a cue or change a variable of the lighting.

Another embodiment of the invention is described with reference to the flowchart of FIG. 5. This embodiment adds a filter to the previous MIDI monitoring activities. This filter allows only specified contents to effect the lighting sequence. The filter provides capability for the performer to control the actual operation.

Figure 5:
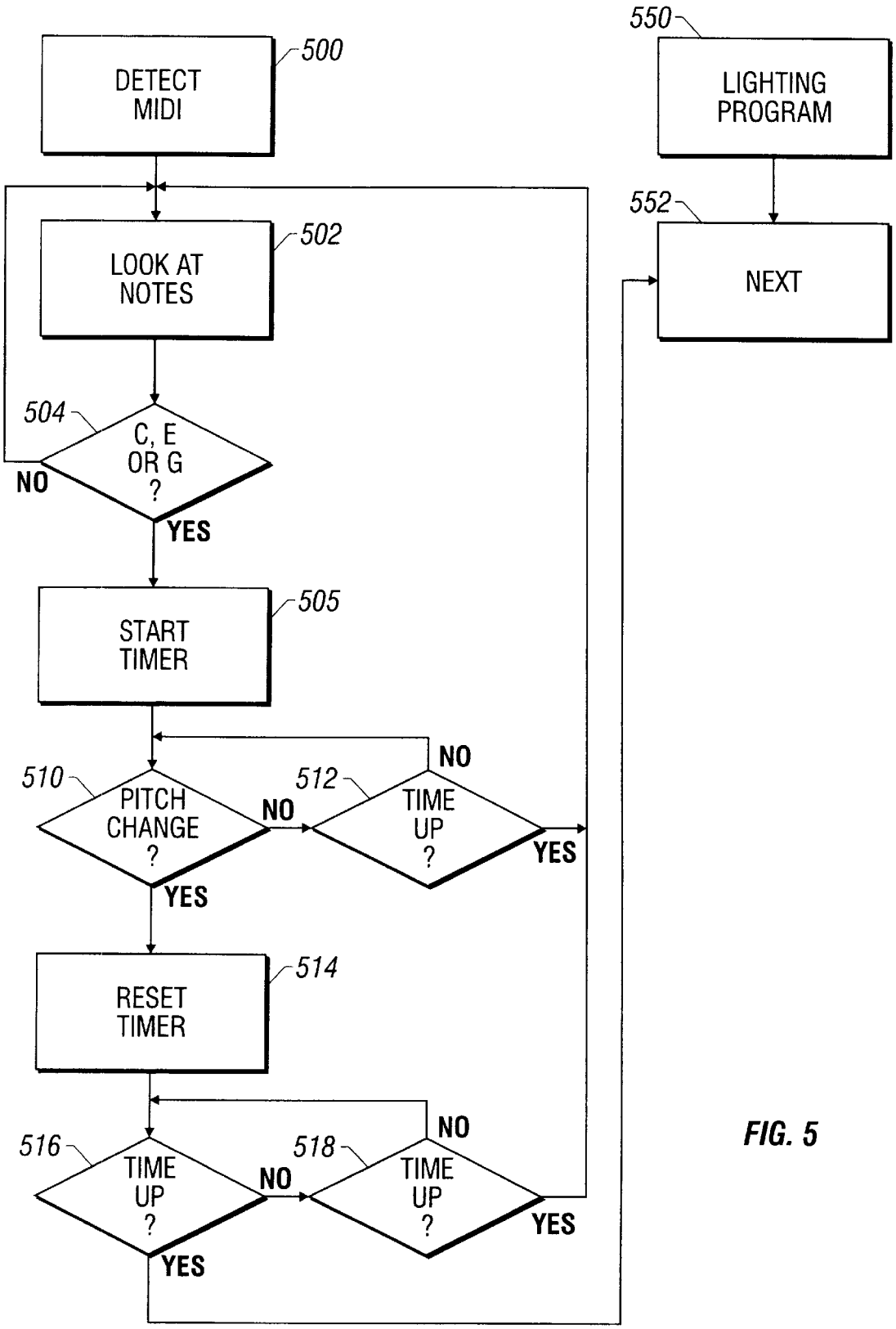
FIG. 5 shows a flowchart of a filter that investigates the note stream to find "C" chord.
Figure 5A:
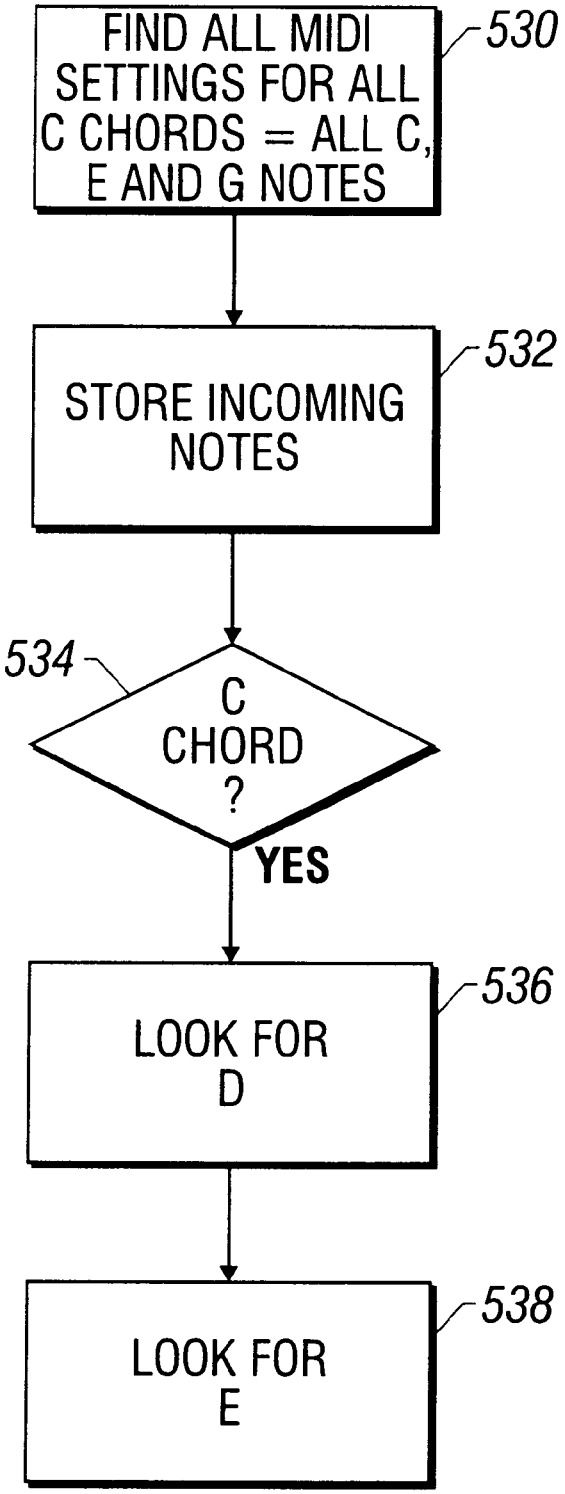
FIG. 5A shows detection of a chorus of a song.

FIG. 5 shows the lighting program 550 running in parallel with the detection of MIDI data 500. In this embodiment, a sequence of MIDI occurrences is used as a filter to control certain operations. The filter operation is carried out by looking for specified sequences in the MIDI data. Any sequence or pattern or even a specific single note could be used to effect this command.

Another embodiment uses a sequence of notes to effect the filter operation. In the description that follows, a C chord (notes C, E, and G) filter is used. The exemplary filter allows the notes to be received in any order, so long as they are received within a certain time. Therefore, a cue for "next" satisfies the filter parameters if it was a C chord or a quickly-played C scale. Those notes that satisfy the filter parameters effect the synchronization.

Step 502 initiates the filter operation by investigating MIDI notes to determine if any of the MIDI notes correspond to any of the filtering MIDI criteria. Step 504 determines whether the guitar has played any C, E, or G note. If not, control returns to step 502 which continues to look for these desired notes.

If a specified note is detected at 504, a timer is started at 505. This timer might be, for example, a two second timer within which the rest of the filtered elements need to be received. This flowchart shows that a C note has been received, so control passes to step 510 where the system looks for an E or a G note. Each time a note is rejected as not being E or G, a test is made at 512 to determine if the timer has elapsed. If not, the next note is investigated. If the timer elapses, however, the sequence is rejected as not meeting the predetermined criteria. This resets the filter which passes control to step 502 to look for the first note in the sequence once again.

If a note is detected at step 510, the timer is restarted at step 514, and control passes to step 516 which looks for the last note of the filter. We will assume that E has been detected, and therefore the operation at 516 investigates for a G note. If the G is found within the timer interval detected at 518, the system returns to a message to the lighting control program at 552 indicating the synchronization and that the next operation in the sequence can be carried out.

The above describes an operation where a C chord is detected and in which the note order is not important. However, other sequences where note order are important could be accommodated by the above-discussed flowchart by requiring a certain order of notes being received in the FIG. 5 flowchart.

An important feature of this aspect of the present invention is providing control over the time when a certain sequence is operated. The filter allows determination of a certain sequence and effectively allows the performer to control certain aspects of the lighting show.

As an example, many songs include improvisation intervals within the song. The lead guitar player, for example, may have time to play an improvised session of musical notes during this improvisation interval. The lighting effect during this improvised session may differ from the lighting effect that is desired during other parts of the song.

The lighting console operator may not know how long their improvisation time will last. However, the system of the present invention enables this lighting control to be adaptively determined. The guitar player needs to decide the final note sequence that will be played prior to returning to the non-improvisational part of the song. That note sequence should not be played by the guitar player at any other time during the improvisation. The system monitors for that note sequence, and when received, that note sequence signals the return to the other part of the lighting show.

One application of this embodiment is the ability to automatically detect the chorus of a song and change some stage lighting based on that detection. In order to do this, the logic filter is operated to detect many different variations ("left wide open"), as will be described herein.

The system of FIG. 5 is a flowchart showing this operation of investigating to look for the chorus of a song. That chord is defined by a predetermined sequence of notes or chords that occur in a predetermined relation with one another. This example assumes that the chorus that is acting as the filter is defined by a C chord, followed three seconds later by a D chord, and two seconds later by an E chord.

The detection system, therefore, uses a complex filter to look for a C chord. This is done by using a wide open logic system to find any C chord, played by any instrument, and at any octave range, e.g., high C, middle or lower C. This requires a number of comparisons. The system therefore looks for any C chord being played: that is, any combination of C, E and G notes being played within 300 milliseconds of one another.

At step 530, a list of the many designations corresponding to every C, E and G note within the spectrum is assembled. The system continually stores all data corresponding to incoming notes within its working memory at 532. At step 534, the system investigates the contents of the working memory to determine if the other components of the C chord are present therein. If so, a detection of a C chord is established and similar operations are taken to look for a D chord at 536. A housekeeping operation removes all entries that are older than 300 milliseconds.

When the C chord is detected at step 510, this time is defined by a time stamp in the memory. At time t+1½ seconds, the operating system continues searching for notes identifying the D chord. The D chord search progresses similar to that discussed above with respect to the C chord, and continues until time t=2½ seconds. If the D chord is not found within that time, the previous trace is erased, and control returns to step 502 which continues looking for notes identifying the chorus.

A similar operation is carried out for the subsequent E chord at 538, with some time leeway allowed as described above. In this way, the C, D and E chords can be detected, thereby determining the beginning of the chorus of the song.

Another embodiment of the present invention relates to a specific problem in random order improvisation shows. Specifically, the lighting operator often needs to know what song is being played to decide on the proper lighting sequence to be used. However, some artists prefer to keep the order of songs spontaneous. Without a predefined order, the lighting designer often does not know which song is being played next. The lighting designer therefore cannot provide the proper lighting effect until the lighting designer can recognize enough about the song to decide how to proceed. Once the song is determined, moreover, it still may take the lighting operator at least many seconds to initiate the proper settings.

This aspect of the present invention addresses this problem. Lighting effects for such an operation are planned in advance during a planning stage. The lighting operators and the performer agree on the lighting effect that will accompany each song during that planning stage. According to this aspect of the present invention, the planning also includes an indication of musical production message settings for that song, e.g., the MIDI settings for the MIDI instruments during that song. This includes a determination of the instruments that are plugged in, their settings, volumes and the like. These ideal instruments and settings are used to form a table or database. This database includes an identifier of the song (e.g., song number) and the MIDI settings and plug-ins associated with that song.

In operation, as the performers begin to play their song, they must decide amongst themselves which song it will be. As they decide that, they begin to appropriately adjust their musical instruments. The MIDI settings are continually monitored, and compared against all songs in the database. When the collection of settings comes close enough to those indicating a specific song in the database, e.g., within 10% to 20% of preset settings, then the settings are recognized as representing that song. This causes an initiation of the lighting effect for that song.

This embodiment can be used to detect sequences other than songs, and can also be combined with other embodiments in which the system looks for a certain combination of information with which to synchronize.

Figure 6:
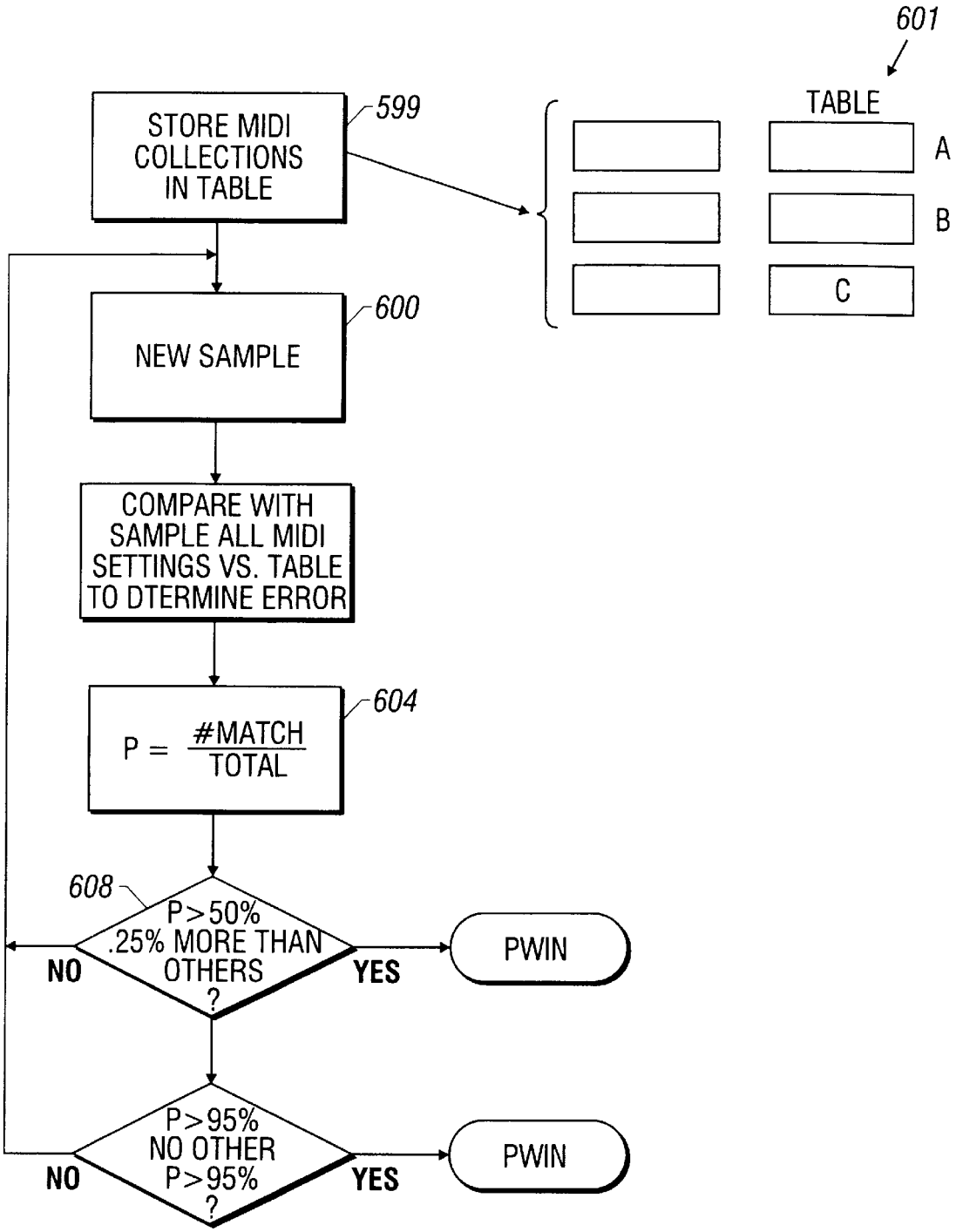
FIG. 6 shows an embodiment which automatically detects which song is being played.

The operation for detecting the current song being played is diagramed in FIG. 6. An initial step 599 stores MIDI settings for instruments associated with each song into a table 601. For example, the table 601 stores information for song A in the "A" locations and so on. A sample of MIDI current settings is taken at step 600. Step 602 compares the current sample of MIDI settings with all entries in the table 601. Step 602 also determines the error between the current set of MIDI settings and each entry in the table.

$$P = \frac{\text{number of items that match}}{\text{total number of items}} \text{ at 604.}$$

A list of all P's is compiled. That list is investigated until one of those P's becomes the clear leader. This embodiment decides a value to be a clear winner if that value is greater than 50% and 25% greater than any other value at step 608. An alternative technique of determining a win is established if any value is greater than 95% and no other value is greater than 95% at step 610.

If the results of both tests are negative, control returns to the sampling step 600.

It is important according to the present invention to define some acceptable amount of error. This is because the artists often forget the exact settings they are supposed to use, and may themselves make some errors in the settings of their instruments. Too close a requirement can cause the artists to make an error, and not recognize their proper song.

Another embodiment of the invention applies the techniques of any of the previous embodiments to monitoring and control of other devices The techniques can be used to control any device which has any association with music industry, but not limited to LaserDisk players, CD Rom drives, video projectors, video switchers, digital video image machines, gobos, or other devices.

Although only a few embodiments have been described in detail above, those having ordinary skill in the art will certainly understand that many modifications are possible in the preferred embodiment without departing from the teachings thereof.

For example, the musical stream can be used to control many other parameters besides those described above. The tempo of the MIDI stream can be used to change the clock, for example. Any of the MIDI attributes can be used to control intensity, tracking, loudness, or any other controllable feature of lighting or any other part of the show.

The filter can also be used with many other elements. A long string of events can be used to identify portions of songs, a guitar solo, acoustic drama or musical operations.

The filter can look for a specified sequence of cymbal crashes, percussive elements, voices, or any other elements.

Other monitored parts of the musical production could be attitude of the musical artist could be used, such as position of the user's hand on the microphone stand.

All such modifications are intended to be encompassed within the following claims.

What is claimed is:

1. A musical accompaniment system, comprising:

a musical instrument, producing music and producing a signal indicating musical events in the music; and a non-musical system, producing an accompaniment to the musical events, said non-musical system including an indicating signal monitoring element, monitoring said signal indicating musical events, and using said signal indicating musical events to adapt some aspect of the accompaniment to the musical events.

2. A system as in claim 1, wherein said non-musical system is a stage lighting system, and said accompaniment is a lighting effect produced by the stage lighting system.

3. A system as in claim 2, wherein said indicating signal is a MIDI signal.

4. A system as in claim 3, wherein said using comprises synchronizing some aspect of the lighting effect to MIDI events within said MIDI musical signal.

5. A system as in claim 3, wherein said using comprises determining a particular song being played from said MIDI signal.

6. A stage lighting system, comprising:

(a) a first element which provides a music production message indicative of some aspect of music being produced in some part of a musical show; and (b) a stage lighting control, monitoring and responsive to said music production message, and carrying out some aspect of control of said stage lighting system unrelated to music production, based on said music production message, said aspect of control being triggered by a preset sequence of music events in said musical production message.

7. A control system for a musical system, comprising:

(a) a musical system, producing MIDI information indicating some aspect of a sound part of a musical production; and (b) a non-musical system, accompanying the musical production, and controlled by the MIDI information that is produced by the sound part of the musical production, such that a specified sequence of the MIDI information indicating the sound part controls some aspect of the non musical system, said specified sequence of MIDI information including at least two MIDI events in a specified order.

8. A system as in claim 7, wherein the MIDI information changes a lighting effect controlled by the non musical system.

9. A control system for a musical system, comprising:

a) a musical system, producing MIDI information indicating some aspect of a sound part of a musical production; and (b) a non-musical system, accompanying the musical production, and controlled by the MIDI information that is produced by the sound part of the musical production, such that the MIDI information indicating the sound part controls some aspect of the non musical system;

wherein said MIDI information synchronizes some aspect of the non-musical system with the musical production and also chances a lighting effect controlled by the non musical system; and wherein a pitch change in said MIDI information changes the lighting effect.

10. A system as in claim 9, wherein a pitch change in said MIDI information changes a hue of the lighting effect.

11. A system as in claim 9, wherein a change in said MIDI information changes a physical pointing direction of lights forming the lighting effect.

12. A system as in claim 7, further comprising a filter for said MIDI information, so that only a specified content of MIDI information causes the control of the non-musical system.

13. A system as in claim 12, wherein said filter includes detection of certain musical notes.

14. A system as in claim 13, wherein said filter detects a chorus of a song.

15. A system as in claim 13, wherein said filter detects specified notes indicating an end of an improvisational sequence.

16. A filtered synchronization system for a musical system, comprising:

(a) a musical system, producing music production messages indicating a sound part of a musical production; and (b) a non-musical system, accompanying the musical production, and including a music production message detecting device, and a filter that detects specified music production message events within the music production messages and ignores other music production message events and produces an output only when receiving the specified events, said output controlling the non-musical system in accordance with the musical production messages produced by the musical system.

17. A system as in claim 16, wherein said music production message is in MIDI format.

18. A MIDI detecting system, comprising:

(a) a database, storing a plurality of collections of MIDI settings, each collection of MIDI settings associated with a song to be played using those settings;

(b) a music production message detector, connected to a stream of current music production message information, and detecting current music production message settings from said stream of current music production message information; and (c) a controller, which matches said current music production message settings with collections in said database, to determine a song in said database which is being played.

19. A system as in claim 18, wherein said music production message is in MIDI format.

20. A system as in claim 18, wherein said matching device reviews a percentage of musical production messages that match with said collection in said database to determine which one represents a winner.

21. A method of operating a lighting show having separate sequences, comprising:

(a) storing at least first and second lighting effects;

(b) storing an order of said lighting effects whereby said second lighting effect is produced after said first lighting effect;

(c) producing said first lighting effect;

(d) detecting music production messages from a music production that accompanies said light show; and (e) producing of said second lighting effect at a time related to at least one of said music production messages.

22. A system as in claim 21, wherein said music production message is in MIDI format.

23. A system as in claim 21 further comprising filtering said music production messages to find a pre-specified message representing a specified event, and said synchronizes comprises producing said second lighting effect at a time related to said specified event.

24. A automated sequence detection device, comprising:

a plurality of musical instruments producing respective music production messages; and a detection device, monitoring said music production messages, and automatically determining a current sequence from all of the monitored music production messages.

25. A device as in claim 24, wherein said sequence is a song being played.

* * * * *